US006148827A

United States Patent [19]

Hollenstein

[11] Patent Number: 6,148,827

[45] Date of Patent: Nov. 21, 2000

[54] ADJUSTABLE CIGAR ASHTRAY

[75] Inventor: Rene Hollenstein, Oberwil, Switzerland

[73] Assignee: Davidoff & Ci.e. SA, Geneva, Switzerland

[21] Appl. No.: 09/129,446

[22] Filed: Jul. 30, 1998

[51] Int. Cl.[7] ..... A24F 15/08

[52] U.S. Cl. ..... 131/241; 206/246

[58] Field of Search ..... 131/231, 240.1, 131/241, 186, 187, 257, 260; 206/246

[56] References Cited

U.S. PATENT DOCUMENTS

| | | | |
|---|---|---|---|
| 1,902,014 | 3/1933 | Campbell . | |
| 2,011,242 | 8/1935 | Girard | 131/51 |
| 2,208,971 | 7/1940 | Gelardi | 206/38 |
| 5,002,074 | 3/1991 | Kimisawa | 131/231 |
| 5,722,438 | 3/1998 | Gors | 131/231 |

*Primary Examiner*—James Derrington
*Assistant Examiner*—Robert McBride
*Attorney, Agent, or Firm*—Darby & Darby

[57] ABSTRACT

An adjustable cigar ashtray having a body including a base and at least first and second, opposing, side walls, and a slidable bridge member mounted between the first and second side walls, wherein the bridge member is slidable along a predefined path substantially parallel to the first and second side walls.

4 Claims, 2 Drawing Sheets

ADJUSTABLE CIGAR ASHTRAY

BACKGROUND OF THE INVENTION

1. Field of the Invention

The present invention relates to ashtrays in general, and more particularly, to a cigar ashtray.

2. Description of the Related Art

There are various shapes and forms of ashtrays known in the art. In particular, there are ashtrays designed especially to rest a cigar and retain cigar ashes.

One known type of cigar ashtray, for example, manufactures for Davidoff, includes a generally rectangular base plate, four side walls, and a bridge member which is mounted at a fixed position, e.g., across the middle of the ashtray, between two opposite side walls, parallel to the other two side walls. The top surface of the bridge member includes a number of concavities for securely resting cigars. When a cigar is rested on the ashtray, the foot end is supported by one of the concavities of the bridge member, and the cap end is supported by a top edge of one of the side walls parallel to the bridge member. This ensures that the cigar ashes are collected by the ashtray and that the cigar is generally supported along its entire length in a position that allows even burning between taking draws.

The concavities on the bridge member may have different sizes, i.e., different radii of curvature, to accommodate different diameters of cigars. The position of the bridge member, i.e., the separation between the bridge member and the side walls on either side, is selected to comfortably accommodate a standard cigar size.

SUMMARY OF THE INVENTION

Ashtrays with a fixed bridge member do not accommodate all cigar sizes and/or cigars that have been smoked down to cigar butt.

It is therefore an object of the present invention to provide an adjustable cigar ashtray which may be easily adjusted to accommodate different cigar lengths.

Thus, the present invention provides an ashtray having a slidable bridge member, that can easily be positioned at a variable distance from a side wall of the ashtray.

In an embodiment of the present invention, there is provided an adjustable cigar ashtray having a body including a base and at least first and second, opposing, side walls, and a slidable bridge member mounted between the first and second side walls, wherein the bridge member is slidable along a predefined path substantially parallel to the first and second side walls.

Other objects and features of the present invention will become apparent from the following detailed description considered in conjunction with the accompanying drawings. It is to be understood, however, that the drawings are intended solely for purposes of illustration and not as a definition of the limits of the invention, for which reference should be made to the appended claims.

BRIEF DESCRIPTION OF THE DRAWINGS

The present invention will be better understood from the following detailed description of a preferred embodiment of the invention taken in conjunction with the following drawings in which.

DETAILED DESCRIPTION OF THE PRESENTLY PREFERRED EMBODIMENTS

Figure 1:
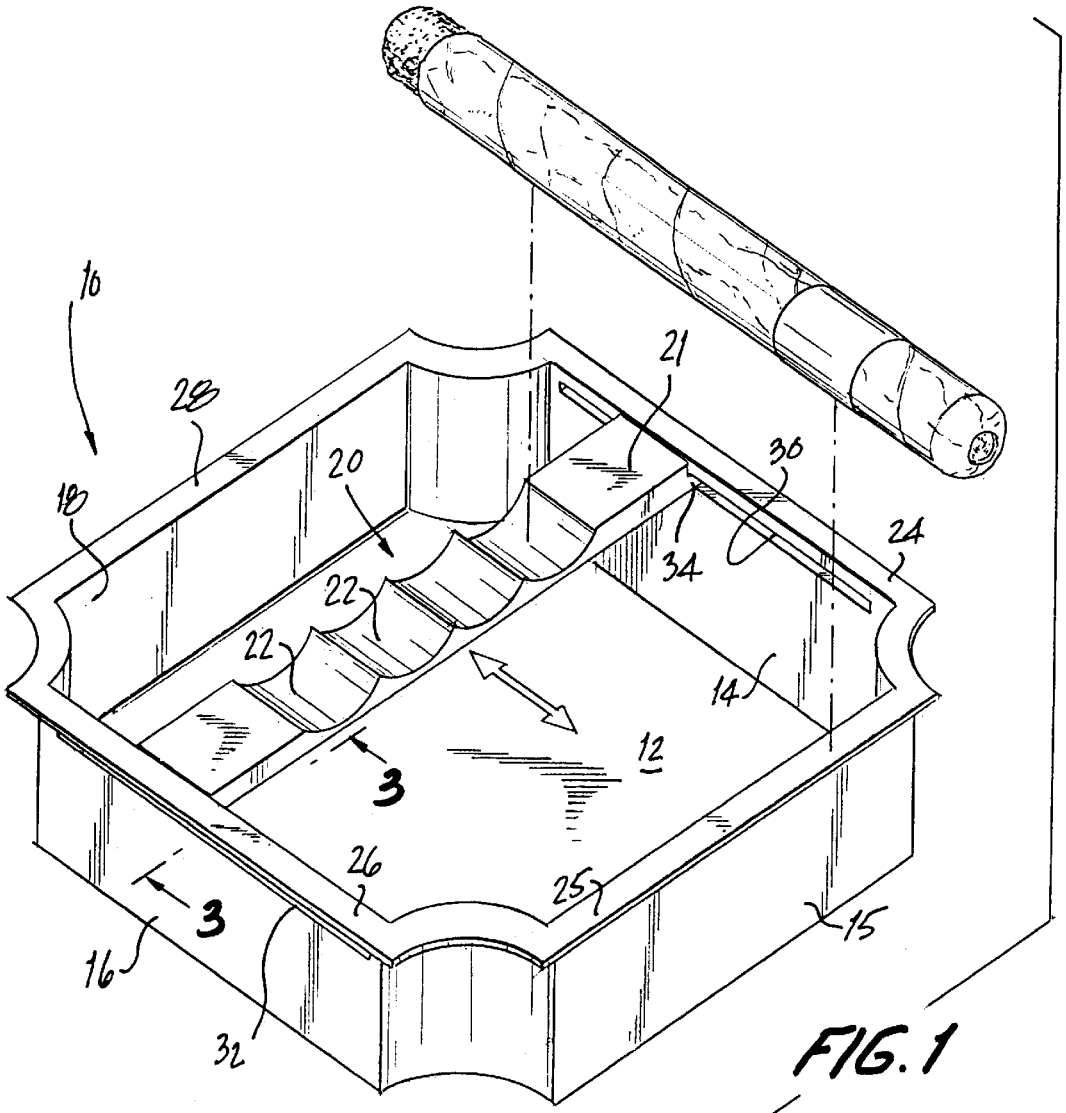
FIG. 1 is a schematic, perspective view, illustration of an adjustable cigar ashtray in accordance with an embodiment of the present invention.

Reference is made to FIG. 1 which schematically illustrates an adjustable cigar ashtray 10 in accordance with an embodiment of the present invention. Adjustable cigar ashtray 10 includes a base plate 12 and side walls 14, 15, 16 and 18, having wide top edges 24, 25, 26 and 28, respectively. Walls 14, 15, 16 and 18 may be integrally formed as a single, generally rectangular or square, unit mounted along the edges of base plate 12, e.g., using screws, as is known in the art.

In accordance with an embodiment of the present invention, ashtray 10 includes a slidable bridge member 20 which is mounted across the ashtray between walls 14 and 16. The ends of bridge member 20 are slidably mounted in slots 30 and 32 formed in walls 14 and 16, respectively, as described below. In this arrangement, bridge member 20 can be continuously moved from a first extreme position, nearest wall 15, to a second extreme position, nearest wall 18, while remaining substantially parallel to walls 15 and 18. When the slidable bridge member 20 is moved across the open body of ashtray 10 from the first extreme bridge position nearest the wall 15 to the second extreme bridge position nearest the wall 18, the first extreme bridge position provides a first open space between the slidable bridge member 20 and the wall 15 and a second open space between the slidable bridge member 20 and the wall 18. In the second extreme bridge position a third open space is defined between the slidable bridge member 20 and the wall 18 and a forth open space defined between the slidable bridge member and the wall 15, as is seen in FIG. 1.

Figure 2:
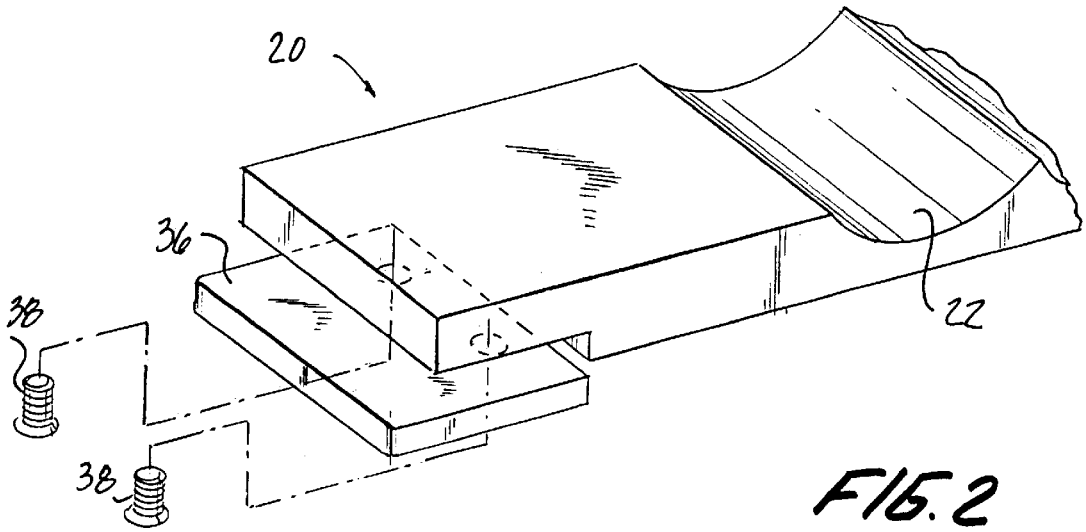
FIG. 2 is a schematic, perspective view, illustration of a slidable bridge member of the adjustable cigar ashtray of FIG. 1.

Reference is now made also to FIG.2 which schematically illustrates bridge member 20 in greater detail. Bridge member 20 includes a first end portion 34 and a second and portion 36. When bridge member 20 is mounted on ash-tray 10, protrusion bar 34 is slidably accommodated by slot 30 of side wall 14 and protrusion 36 is slidably accommodated by slot 32 of side wall 16. End Portions 34 and 36 preferably have rounded corners which enable smoother sliding of the end portions in their respective slots.

To enable convenient mounting and dismounting of bridge member 20 on ashtray 10, end portion 36 of bridge member 10 may be a separate piece, as shown in the drawings. The separate end portion 36 may be mounted to bridge member 20, using screws 38 (as shown in FIG. 2) or any other fastening means known in the art, after placing end portion 34 and end portion 36 in slots 30 and 32, respectively, of walls 14 and 16.

As further shown in FIGS. 1 and 2, a top surface 21 of bridge member 20 includes a number of concavities 22, for example, four concavities 22 as shown in the drawings. Concavities 22 may all have substantially the same radius of curvature (as shown in the drawings), corresponding to the diameter of an average cigar type. Alternatively, concavities 22 may have different radii of curvature, to accommodate different cigar diameters.

During smoking, a cigar may be rested on ashtray 10 such that the foot end, i.e. the lit end of the cigar, is supported by one of concavities 22, and the cap end of the cigar is supported either on top edge 25 of side wall 15 or on top edge 28 of side wall 18. In this arrangement, the cigar is comfortably supported at two locations, namely, by side wall 15 or 18 and by bridge member 20, and the supporting concavity 22 prevents the cigar from rolling off the ashtray. If concavities 22 have variable radii of curvature, the cigar may be rested on the concavity that is most suitable in shape to accommodating the cigar.

In accordance with the present invention, the position of bridge member 20 relative to side walls 14 and 16 may be adjusted to suit the length of the cigar or cigars being rested on ashtray 10. For example when bridge member 20 is at its first extreme position, i.e., closest to side wall 15, a relatively long cigar may be rested between bridge member 20 and side wall 18, and a relatively short cigar may be rested between bridge member 20 and side wall 15. If an initially long cigar is repeatedly smoked and re-rested on ashtray 10, the position of bridge member 20 may be continuously adjusted to account for the continuous shortening of the cigar. In the extreme positions of bridge 20, i.e., nearest to side wall 15 or 18, the distance between bridge member 20 and the nearest side wall may be sufficiently short to accommodate a short cigar butt that may remain towards the end of the smoking process.

Cigar ashtray 10 may be formed of any suitable material known in the art, for example, any suitable metal. In an embodiment of the present invention, ashtray 10 is formed of the metal, as used for the Davidoff cigar ashtray.

The ashtray may also be formed in one piece including slots 30 and 32, either machined or molded. The first end portions 34 and second end portions 36 of the bridge 20 may be fixedly attached or adjustably attached to the bridge, as long as they may be inserted into the slots 30 and 32 for smooth gliding.

Figure 3:
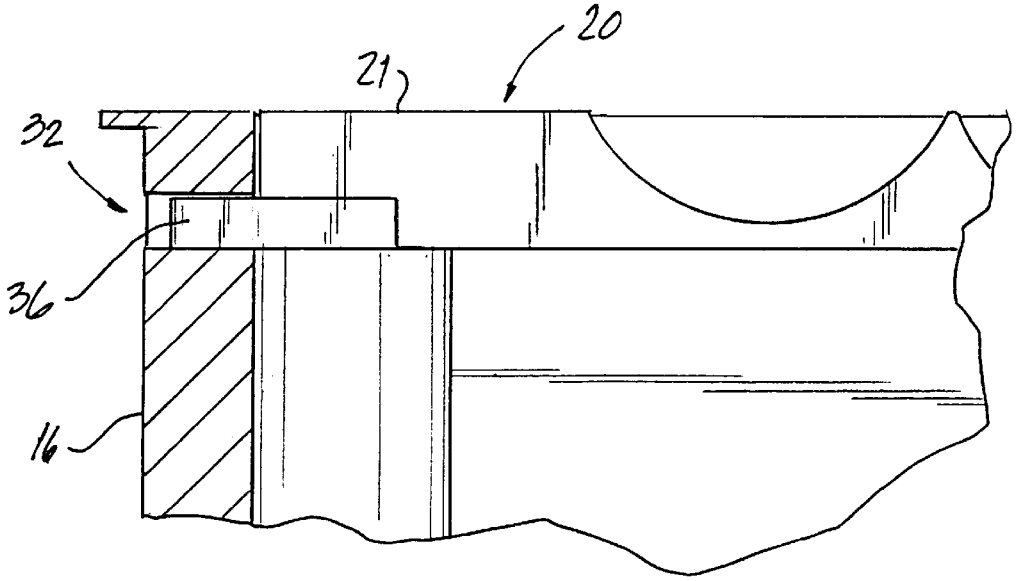
FIG. 3 is a schematic, perspective partial view, illustrating a slideable bridge member.
Figure 4:
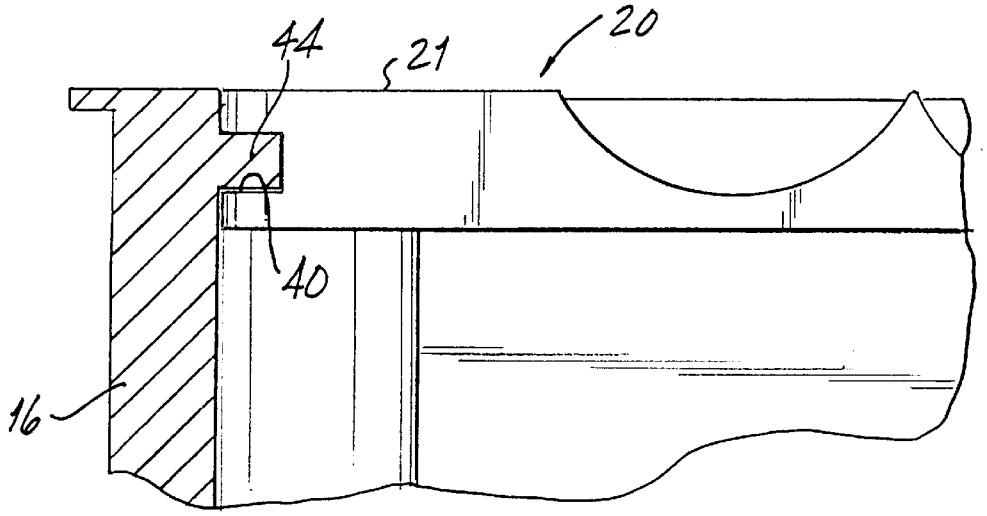
FIG. 4 is a schematic, perspective partial view, illustrating a side wall which may accept the slideable bridge member of FIG. 3.

As shown in FIGS. 3 and 4, it is also contemplated that the ashtray provides for protrusions 40 and 42 in sidewalls 14 and 16, which glidingly accept a bridge that accommodates the protrusions, for example by providing indentations or grooves 44 and 46 on each side of the bridge. Accommodations for mechanically mounting the glidable bridge may also include means such as fasteners or springs.

Thus, while there have been shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

What is claimed is:

1. An adjustable cigar ashtray, comprising:

an open body including a base and first and second opposing side walls;

a slidable bridge member mounted across the open body between said first and second side walls;

third and fourth opposing side walls substantially parallel to said bridge member, wherein said bridge member is slidable along a predefined path substantially parallel to said first and second side walls, wherein said first and second side walls have first and second slots, respectively, defining said path and wherein said bridge member includes first and second end portions slidably accommodated by said first and second slots, respectively, wherein said slidable bridge member is movable across the open body from a first extreme bridge position nearest the third wall to a second extreme bridge position nearest the fourth wall, such as to provide in the first extreme bridge position a first open space between the slidable bridge member and the third wall and a second open space between the slidable bridge member and the fourth wall; and to provide in the second extreme bridge position a third open space defined between the slidable bridge member and the third wall and a forth open space defined between the slidable bridge member and the fourth wall.

2. An adjustable ashtray according to claim 1, wherein said bridge member has a plurality of concavities, each concavity adapted to support a portion of a cigar rested on the ashtray.

3. An adjustable ashtray according to claim 1, wherein said bridge member has at least one concavity.

4. An adjustable ashtray according to claim 1, wherein said first and second side walls have first and second protrusions, respectively, defining said path and wherein said bridge member includes first and second portions slidably accommodated by said first and second protrusions.

* * * * *

UNITED STATES PATENT AND TRADEMARK OFFICE

CERTIFICATE OF CORRECTION

PATENT NO. : 6,148,827

DATED : November 21, 2000

INVENTOR(S) : Rene HOLLENSTEIN

It is certified that error appears in the above-identified patent and that said Letters Patent is hereby corrected as shown below:

Title page, item [73]Assignee, change "Davidoff & Ci.e. SA."

to - -Davidoff & Cie. SA.- -.

Signed and Sealed this

Twenty-second Day of May, 2001

*Attest:*

NICHOLAS P. GODICI

*Attesting Officer*

*Acting Director of the United States Patent and Trademark Office*